United States Patent [19]

Mellsjö

[11] Patent Number: 4,697,636

[45] Date of Patent: Oct. 6, 1987

[54] HEAT EXCHANGER WITH HELICAL FLUID FLOW

[76] Inventor: Carl G. Mellsjö, Helsingevaägen 7, Vallentuna, S186 00, Sweden

[21] Appl. No.: 777,776

[22] PCT Filed: Jan. 23, 1985

[86] PCT No.: PCT/SE85/00025

§ 371 Date: Sep. 13, 1985

§ 102(e) Date: Sep. 13, 1985

[87] PCT Pub. No.: WO85/03563

PCT Pub. Date: Aug. 15, 1985

[30] Foreign Application Priority Data

Feb. 3, 1984 [SE] Sweden ..... 8400566

[51] Int. Cl.[4] ..... F28D 7/10

[52] U.S. Cl. ..... 165/156; 165/159; 165/161; 165/163

[58] Field of Search ..... 165/159, 161, 162, 163, 165/156; 110/332

[56] References Cited

U.S. PATENT DOCUMENTS

| | | | |
|---|---|---|---|
| 1,224,335 | 5/1917 | Smith | 165/163 |
| 1,492,337 | 4/1924 | Reid | 110/332 |
| 1,893,484 | 1/1933 | Belt | 165/163 X |
| 2,052,856 | 9/1936 | Truelsen | 165/163 X |
| 2,108,691 | 2/1938 | Mustee | 165/159 X |
| 2,456,564 | 12/1948 | Muller | 165/159 |
| 3,630,276 | 12/1971 | Paine et al. | 165/158 |
| 3,669,630 | 6/1972 | Filatov et al. | 165/159 X |
| 4,371,036 | 2/1983 | Fordsmand | 165/163 |

FOREIGN PATENT DOCUMENTS

| | | |
|---|---|---|
| 117820 | 9/1984 | European Pat. Off. . |
| 2221734 | 11/1972 | Fed. Rep. of Germany . |
| 2410292 | 9/1975 | Fed. Rep. of Germany . |

*Primary Examiner*—William R. Cline
*Assistant Examiner*—Randolph A. Smith
*Attorney, Agent, or Firm*—Shapiro and Shapiro

[57] ABSTRACT

A heat exchanger for exchange of heat between two media, especially gas and liquid, in heat pumps and the like, including an elongated, generally cylindrical space (2) passed through by one medium and having an inlet (3) arranged at one end and an outlet (7) at the other end, and a helical wall radially defining said space and delimiting a space through which the other medium is intended to flow. The novelty is that the inlet (3) into the cylindrical space (2) is tangentially arranged, whereby the tangent line through the inlet is generally parallel with a tangent drawn from the helical line of the wall, that between the two ends of the cylindrical space there is arranged a number of bodies (12, 12', 12') securing the intended circulatory movement, substantially blocking the central portion of the space in axial direction and adapted to utilize the interspace (11) between the coil turns as guide elements maintaining the media circulation, by guiding outwardly towards the wall the medium flowing through said space (2).

6 Claims, 8 Drawing Figures

HEAT EXCHANGER WITH HELICAL FLUID FLOW

The present invention relates to a heat exchanger for exchange of heat between two media, especially gas and liquid, in heat pumps and the like, including an elongated, generally cylindrical space passed through by one medium and having an inlet arranged at one end and an outlet at the other end, and a helical wall radially defining said space and delimiting a space through which the other medium is intended to flow.

There are known heat exchangers consisting of a generally cylindrical casing the ends of which are provided with respectively an inlet and outlet for one medium, preferably the gas, and a helical pipe coil arranged within the space in said casing and through which the other medium, preferably the liquid, is allowed to flow. In a manner per se known the media are suitably allowed to flow in opposite directions. The hot medium, which enters at one end of the casing, may to begin with have a rotary movement so that it will sweep along the pipe coil; but this movement decreases rapidly and the gas flows substantially linearly through the casing, i.e. through the space within the pipe spiral, with the result that the heat exchange in that portion of the casing which is remote from the inlet will be deficient.

The object of this invention is to provide a substantially improved efficiency by a modification of heat exchangers of the above-mentioned type.

The essential characteristic of the apparatus according to the invention is that the inlet into the cylindrical space is tangentially arranged, whereby the tangent line through the inlet is generally parallel with a tangent drawn from the helical line of the wall, that between the two ends of the cylindrical space there are arranged a number of bodies securing the intended circulatory movement, substantially blocking the central portion of the space in the axial direction and adapted to utilize the interspace between the coil turns as guide elements maintaining the media circulation, by guiding outwardly towards the wall the medium flowing through said space.

Examples of embodiments of heat exchangers according to the invention will be described more fully below with reference to the accompanying drawing in which.

Figure 1:
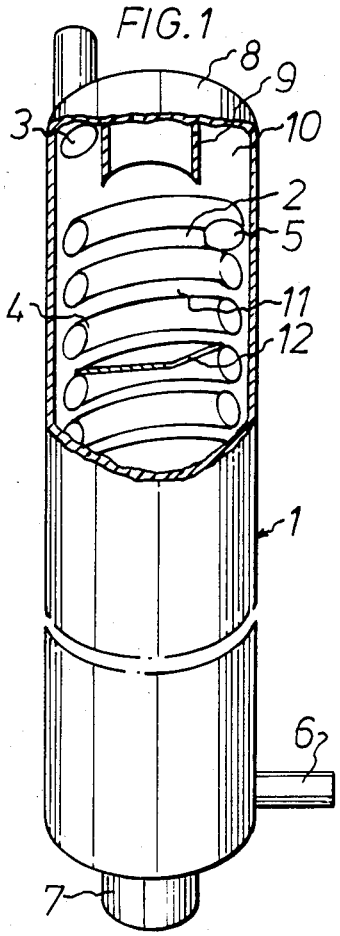
FIG. 1 is a cross-section through a heat exchanger according to the invention.

In the drawing, 1 designates a generally cylindrical casing constituting the space or compartment through which one medium, i.e. the gas, passes. Arranged at one end of the casing is a tangential inlet 3 through which the warm gas from a hot gas source, e.g. a compressor in a heat pump, flows into the space 2 in the casing. Arranged within the casing 1 in the space 2 is a helically wound pipe coil 4 and this has an inlet 5 and an outlet 6. The outlet 7 of the casing 1 may be axial but it may of course also be tangentially arranged.

A rotary movement is imparted to the inflowing medium by means of the tangential inlet 3, and to secure this movement during an intial stage a coaxially disposed guide surface 9 is arranged at the end wall 8 of the casing. After having left the inlet opening the medium will thereby be guided by a slot 10 situated between the guide surface 9 and the casing wall 1 and advance along the wall of the space 2.

After the medium has left the slot 10 between the guide surface 9 and the casing 1 it will pass along the pipe coil 4 and primarily in the interspace 11 between the coil turns. See arrows indicating flow path in FIG. 1A. Gradually, as the speed decreases, the influence of the centrifugal force will be reduced so that the medium will instead pass on through the space within the pipe coil, resulting in a considerably reduced heat exchange.

In order to avoid this and to maintain the rotary movement there is, according to the invention, arranged at least at one point between the two ends of the pipe coil 4 a body maintaining the circulation. In the embodiment according to FIG. 1 this body consists of a washer 12 having a diameter closely joining the inner diameter in the casing 1. The washer is provided with a slit recess 13 and is helically turned so that it can be introduced between the coil turns of the pipe coil 4.

As one or more bodies maintaining the circulation, e.g. the washer 12, have been placed at least at one point in the pipe coil 4 the gas still flowing on at a relatively high speed will again be forced into a helical path whereby it will again come into intimate contact with the pipe coil.

Figure 2:
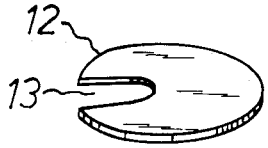
FIG. 2 shows, in perspective, an embodiment of a body maintaining the circulation.
Figure 3:
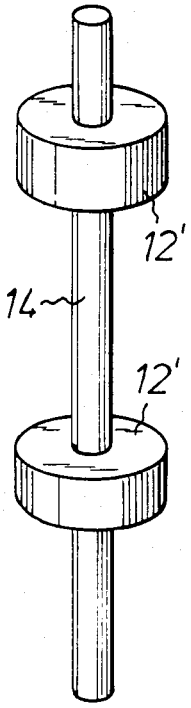
FIGS. 3 and 4 show two other embodiments of such a body.
Figure 4:
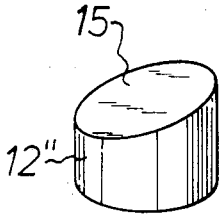
Figure 1A:
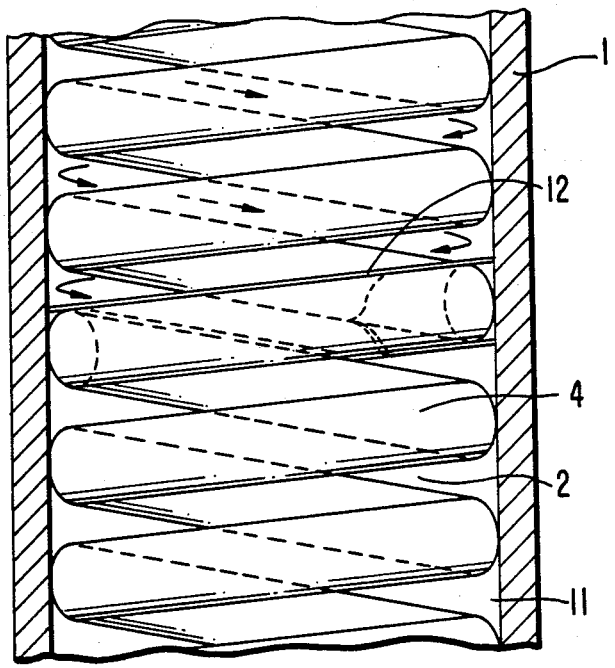
FIG. 1A is a partly sectional detailed view of the heat exchanger of FIG. 1, showing the fluid flow path in the interspace between adjacent coil turns along the periphery of the heat exchanger.

Instead of the washer 12 shown in FIGS. 1 and 2 it is possible, as is shown in FIG. 3, to utilize one or more plugs 12' passed on a rod 14 placed in the free space within the pipe coil. It is also possible to form a plug-like body 12'' so that is will fit in the pipe coil 4 and be retained by it. Such a plug should suitably be provided with an inclined end surface 15.

The washer 12, like the plugs 12' and 12'', ensures that the medium will be forced outwards towards the periphery of the space 2, whereby the medium tries to find its way through the interspace 11 between the pipe coil turns. This imparts a rotary movement to the medium.

It has been found that an efficiency increase of about 50% is obtained by the arrangement of bodies of the above-mentioned type in a heat exchanger of the embodiment herein concerned, as compared to a heat exchanger without such bodies.

Figure 5:
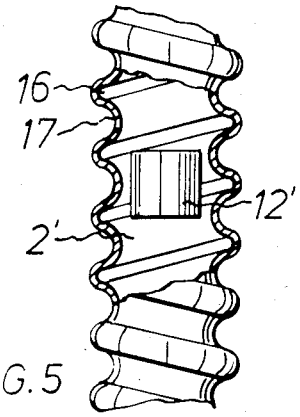
FIG. 5 shows a cross-section of part of another embodiment.

In the embodiment according to FIG. 5, the casing wall 1 itself, instead of the casing wall and the pipe coil 4, is of helical shape so as to constitute a helical trough 16 which axially is defined by equally helical ridges 17. As seen radially beyond said wall 16-17 there is a space through which the other medium flows.

According to the invention there is also in this embodiment a body 12' or 12'' preventing axial flow through the space 2' and adapted to carry the gas in the space 2' outwards towards the helical wall.

Figure 6:
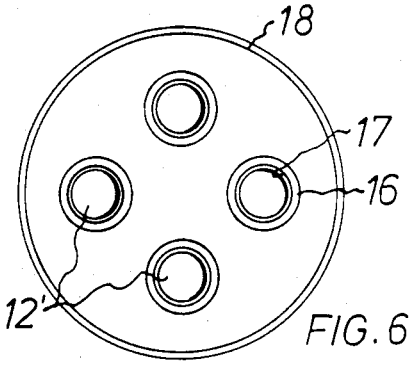
FIG. 6 shows schematically and on a reduced scale an applied construction according to FIG. 5.

The embodiment according to FIG. 5 is particularly apt for composite heat exchangers where, as indicated in FIG. 6, several units may be mounted in a common vessel 18 and where the vessel constitutes a through-flow space for the liquid.

Figure 7:
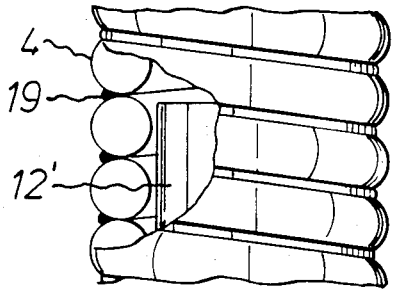
FIG. 7 shows, partly in section, part of still another embodiment of the heat exchanger.

In the further embodiment according to FIG. 7 the pipe coil 4 instead of the casing wall 1 is itself formed as a casing wall in that the tightly wound pipe turns are welded or soldered together, as is indicated by reference numeral 19. Also in this case there is inserted a preventing body 12' adapted to move the medium in the space 2' outward towards the helical wall.

The invention should not be considered restricted to that described above and shown in the drawing but may be modified in various ways within the scope of the appended claims.

What is claimed is:

1. A heat exchanger for exchanging heat between two fluid media, especially a gas and a liquid, and useful in heat pumps and the like, comprising means defining an elongate generally cylindrical space through which one of said media is to be passed and including a helical pipe coil to carry the other of said media, said pipe coil being disposed at the periphery of said space in such a manner that flow of said one medium along the periphery of said space is confined to a helical flow path running along and having respective turns defined by adjacent surfaces of successive turns of said pipe coil, inlet means disposed toward one end of said cylindrical space for introducing said one medium substantially tangentially into said cylindrical space such that the introduced medium will enter and initially follow said flow path, outlet means disposed toward another end of said cylindrical space for allowing the introduced medium to exit said cylindrical space, and one or more radially slit, substantially helically bent washers each fitted to a respective turn of said pipe coil and substantially blocking the space surrounded by said pipe coil in an axial direction, each said washer having a radial slit configured and disposed to guide introduced medium which has deviated from said flow path into the space surrounded by said pipe coil outward and back into said flow path to maintain helical circulation of the introduced medium within said cylindrical space.

2. A heat exchanger according to claim 1, wherein the first-mentioned means includes a substantially cylindrical casing, with said pipe coil and each said washer fitting the inner periphery of said casing.

3. A heat exchanger according to claim 1, wherein the first-mentioned means includes a substantially cylindrical casing and wherein said inlet means includes a tangential inlet of said casing and a guide surface coaxially disposed in said casing adjacent said inlet and radially spaced from the inner periphery of said casing.

4. A heat exchanger according to claim 1, wherein said guide surface projects into said casing from an end wall of said casing.

5. A heat exchanger according to claim 1, wherein said pipe coil is tightly wound with successive turns contacting one another and sealingly bonded together.

6. A heat exchanger according to claim 5, wherein said successive turns are bonded by one of welding and soldering radially outward of the respective contacting surfaces thereof.

* * * * *